US005258809A

United States Patent [19]

Wiedemer

[11] Patent Number: 5,258,809

[45] Date of Patent: Nov. 2, 1993

[54] ELECTROPHOTOGRAPHIC PRINTER OF MODULAR DESIGN

[75] Inventor: Manfred Wiedemer, Ismaning, Fed. Rep. of Germany

[73] Assignee: Siemens Nixdorf Informationssysteme Aktiengesellschaft, Fed. Rep. of Germany

[21] Appl. No.: 927,632

[22] PCT Filed: Dec. 6, 1990

[86] PCT No.: PCT/EP90/02113

§ 371 Date: Aug. 25, 1992

§ 102(e) Date: Aug. 25, 1992

[87] PCT Pub. No.: WO91/13386

PCT Pub. Date: Sep. 5, 1991

[30] Foreign Application Priority Data

Feb. 26, 1990 [EP] European Pat. Off. ..... 90103729.1

[51] Int. Cl.[5] ..... G03G 15/00; G03G 15/01

[52] U.S. Cl. ..... 355/200; 355/326 R; 346/157

[58] Field of Search ..... 355/200, 319, 326, 327; 346/157, 153.1

[56] References Cited

U.S. PATENT DOCUMENTS 2,990,278 6/1961 Carlson ..... 355/281
4,586,812 5/1986 Kaneko et al. ..... 355/24
4,591,884 5/1986 Miyamoto et al. ..... 346/153.1

FOREIGN PATENT DOCUMENTS 0154695 9/1985 European Pat. Off. .
0309588 4/1989 European Pat. Off. .
3329714 2/1984 Fed. Rep. of Germany .
3439901 5/1985 Fed. Rep. of Germany .
59-23355 2/1984 Japan ..... 355/326
2040226 8/1980 United Kingdom .
2127744 4/1984 United Kingdom .

*Primary Examiner*—Joan H. Pendegrass
*Attorney, Agent, or Firm*—Hill, Steadman & Simpson

[57] ABSTRACT

An electrophotographic printer, in particular for printing individual sheets, contains one or more printing modules (10/1 to 10/4) in which the printing apparatus for carrying out the electrophotographic process are constructionally combined. The printing modules are designed as separate constructional units for mounting in a housing of the printer and have fitting elements (32, 33) for arranging the printing modules (10/1 to 10/4) in rows in the housing (34) in an exactly fitting manner. Each printing module (10/1 to 10/4) contains an intermediate carrier (14) with associated fixing elements in order to transfer a toner image, produced on a photoconductive drum (11) onto a recording carrier (15) and to fix there. The printer can be upgraded from a single-color simplex printer to a multi-color duplex printer by multiple arrangement of the printing modules.

9 Claims, 2 Drawing Sheets

ELECTROPHOTOGRAPHIC PRINTER OF MODULAR DESIGN

BACKGROUND OF THE INVENTION

1. Field of the Invention

The invention relates to an electrophotographic printer with a housing and with printing apparatus for printing recording carriers.

2. Description of the Related Art

Electrophotographic printers of this kind are known, for example, from the U.S. Pat. No. 2,990,278 or British Patent 2,040,226.

In these publications, a charge image is produced in a character-dependent manner on a photoconductor with the aid of an exposure device and fed to a developer station. The developed charge image is then lifted off from the photoconductor with the aid of an intermediate carrier consisting of a continuous belt and transferred to a recording carrier. In order to be able to fix the toner image on the recording carrier, the toner image is heated on the intermediate carrier with the aid of a heating device and the heated toner image is applied to the recording carrier via a roller arrangement by means of pressure and heat. After the transfer of the toner image onto the recording carrier, toner which adheres is cleaned from the intermediate carrier in a cleaning station.

In addition, European Published Application 0 154 695 disclosed a nonmechanical printer or copier for multi-color and reverse-side printing which consists of a plurality of devices arranged one behind the other which are operated simultaneously, the recording carrier which emerges from the paper outlet area of the preceding device being fed to the paper inlet area of the subsequent device. A switchable deflection device for the paper web is arranged between the devices. The individual devices can be constructed in a modular manner with intercombining fixing modules and printing unit modules, at least one fixing module following several printing unit modules.

A printer or copier of this kind requires a large amount of space and requires a high degree of constructional outlay.

Depending on the application area, electrophotographic printers are of varying design. It is mainly electrophotographic printers which operate with continuous paper and print using one or two colors are used in conjunction with centralized EDP (electronic data processing) systems. Electrophotographic printers which operate with individual sheets serve as printers for personal computers or decentralized EDP devices. In this case, they can be designed as one-side printers or as duplex printers. Duplex printers serve for printing both sides of the individual sheet.

As a function of the desired performance range of the printers, it has been customary until now to provide different devices with different equipment features. A later development of the existing devices in use was not possible.

This prevents flexible use of the printers and makes manufacture and maintenance more expensive.

SUMMARY OF THE INVENTION

It is therefore the object of the invention to provide an electrophotographic printer of the type mentioned at the beginning which is of simple and functionally reliable design and which can be flexibly adapted to changing performance requirements.

A further aim of the invention is to design the printer in such a way that further upgrading of the printer is possible without difficulties even at the user's premises.

The printer is to be suitable both for single-color and for multi-color printing.

This object is achieved in a printer of the type mentioned at the beginning having a photoconductor with an associated exposure device for producing charge images on the photoconductor, a developer station for inking the charge image with toner, a continuous, belt-shaped intermediate carrier for transferring toner images which have been produced by inking the charge image onto the recording carrier, fixing means for fixing the toner image onto the recording carrier by pressure or heat and cleaning means for cleaning the intermediate carrier and the photoconductor, wherein the process means are constructionally combined to form a printing module which is designed as a separate constructional unit for mounting in the housing and wherein means are provided on the housing and on the printing module for arranging next to one another a variably selectable number of further printing modules along a common transport channel for the recording carrier.

Advantageous embodiments of the invention are characterized by the printing modules having elements for arranging the printing modules in rows in the housing in an exactly fitting manner. The printer elements are constructed as fitting faces arranged on chassis elements of the printing modules with associated fitting elements. In the printer, the printing modules may be floatingly mounted in the housing of the printer.

Various embodiments provide that the printer, when used for printing sheet-shaped recording carriers on both sides, has a transport channel for the recording carrier provided with a turning device for the recording carrier. The printer may be a printer constructed as a multi-color printer with a number of printing modules with colored toner corresponding to the number of elementary colors used.

The invention provides that the first heating devices are provided which set the temperature of the toner image in a contact area between the intermediate carrier and the photoconductor in such a way that the toner is in the pasty state and is transferred to the intermediate carrier by adhesive force. The heating devices comprise heating elements for heating up the photoconductor. Second heating devices are provided which set the temperature of the toner image on the intermediate carrier in such a way that the toner, located in a contact area between intermediate carrier and recording carrier, is in a virtually liquid state of aggregation.

By virtue of the use of printing modules with intermediate carriers in conjunction with corresponding paper guide units, the electrophotographic printer which is preferably designed as a single-sheet printer is suitable both for black/white and color printing and for simplex or duplex printing.

Even a device which is already located at the user's premises can be upgraded without difficulties. Thus, due to the cascadable structure, an upgrading is possible from a single-color printer up to a multi-color printer. By using identical components, manufacture is simplified and maintenance made more easy. The use of a belt-shaped intermediate carrier permits small deflection angles at the printing point, which is advantageous for the fixing process and for the subsequent further movement of the paper.

The printer is also suitable in particular for multi-color printing. The recording carrier is stressed or deformed to a lesser degree in comparison with conventional electrophotographic printers with pressure or heat fixing units, which is an essential advantage for the recording accuracy in the subsequent printing units. The precision of fit in duplex printing and particularly in multi-color printing is increased.

BRIEF DESCRIPTION OF THE DRAWINGS

Embodiments of the invention are illustrated in the drawings and will be explained in greater detail below by way of example. In the drawings.

DETAILED DESCRIPTION OF THE PREFERRED EMBODIMENTS

Figure 1:
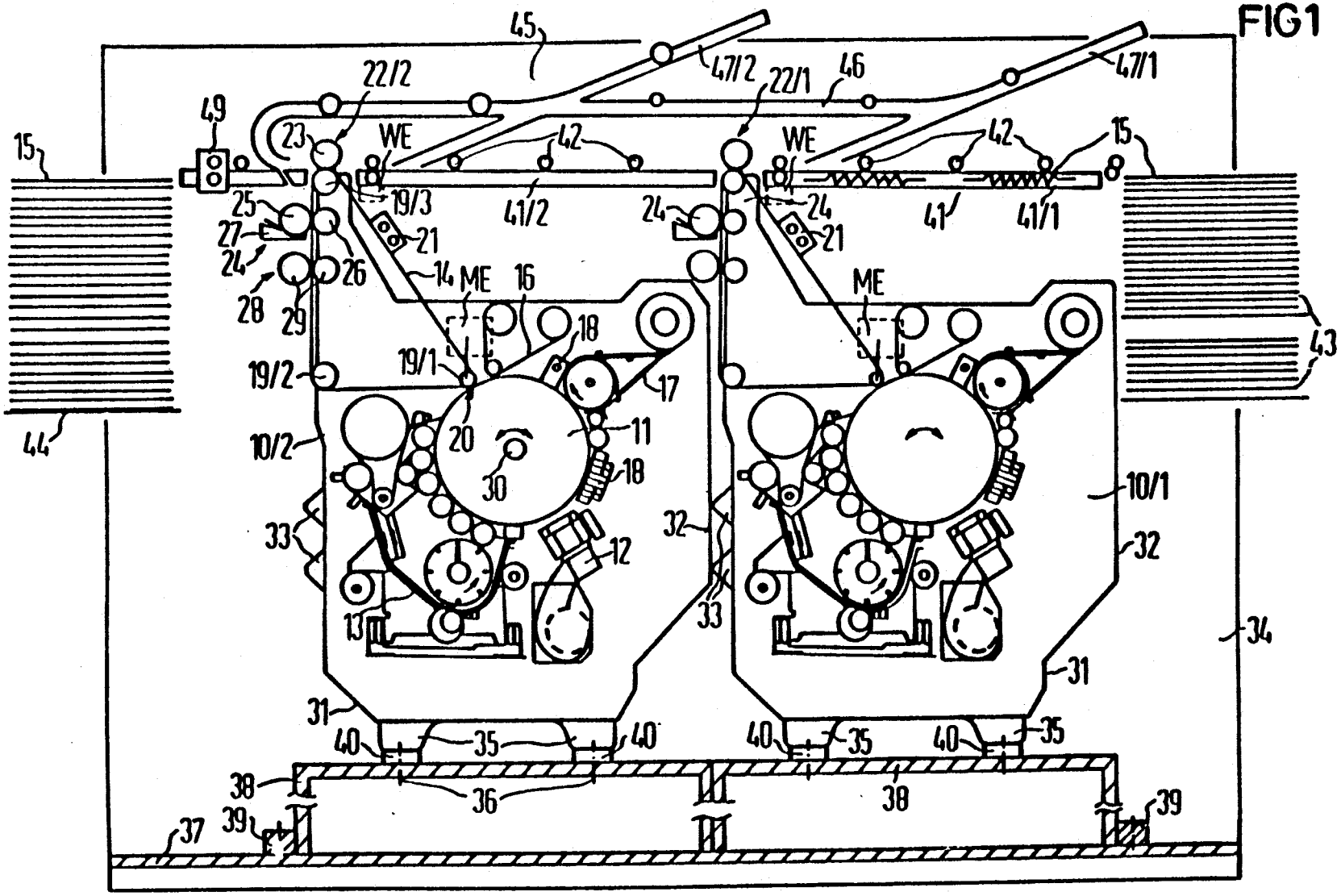
FIG. 1 shows a diagrammatic sectional view of an electrophotographic printer for two-color simplex/duplex printing.

The electrophotographic printer illustrated in FIG. 1 serves for printing individual sheets in two-color simplex/duplex printing. It contains two printing modules 10/1 and 10/2 on which the process means for printing the individual sheets are constructionally combined. These process means comprise: a photoconductive drum 11 which can be driven by an electric motor and has an associated exposure device 12 for producing a charge image on the surface of the photoconductive drum; a developer station 13 for inking the charge image with toner; a continuous, belt-shaped intermediate carrier 14 for transferring a toner image which has been produced by inking the charge image on the photoconductive drum onto the surface of an individual sheet; fixing means which are described later in greater detail for fixing the toner image on the individual sheet by pressure or heat and cleaning means for cleaning the intermediate carrier 14 and the photoconductive drum 11. The cleaning means for the photoconductor consist of a fleece tape 16 and a brush cleaning station 17 which operates with a partial vacuum. In addition, corona discharging and charging devices 18 are provided for discharging and charging the photoconductive drum. An LED character generator which extends over the entire length of the photoconductive drum 11 and which is actuated to produce the charge image on the photoconductive drum 11 in a character-dependent manner serves as the exposure device 12.

The intermediate carrier 14 which is disposed for the purpose of transferring the toner image onto the individual sheet consists of a rubber or silicone tape which is mounted on deflection rollers 19 and, deflected in the region of the transfer point 20 by the deflection roller 19/1 which can be swivelled on and away by a motor-driven device ME, touches the surface of the photoconductive drum 12. By appropriate heating of the intermediate carrier or the photoconductive drum, the temperature at the transfer point 20 is set in such a way that the toner of the toner image is in a pasty state and is transferred to the intermediate carrier 14 by adhesive force. In a heating station 21 which is connected downstream and has heating elements arranged in it, the toner image located on the intermediate carrier 14 is heated to such an extent that the toner is virtually liquified but is still just in the solid state of aggregation. The almost liquid toner image is transferred to the individual sheet at a transfer point 22 to the individual sheet. This transfer point 22 contains for this purpose a roller arrangement consisting of the deflection roller 19/3 and a mating roller 23 between which the individual sheet is fed and fixed to the individual sheet by heat and pressure. The individual sheet is preheated in the paper guide channel on the side to the printed, e.g. by means of a heater WE. As a result, improved fixability of the recording carrier is obtained. In multi-color printing stations, heating in the first station 10/1 is sufficient. The recording carrier which has been heated up stores the heat for the subsequent fixing processes. However, if required, several heating stations (heaters WE) may also be required as a function of the recording carrier. The intermediate carrier 14 is subsequently cleaned in a cleaning station 24. For this purpose, the cleaning station 24 contains a cleaning roller 25 with an associated pressure roller 26. The cleaning roller 25 mechanically or chemically removes toner residues from the intermediate carrier 14, which residues are then stripped off from the cleaning roller 25 at a correspondingly designed flow element 27 or in a cleaning bath.

A combined transport and temperature stabilizing unit 28 which is connected downstream of the cleaning station 24 in the transport direction of the intermediate carrier 14 contains electrically heated or cooled rollers 29 which set the intermediate carrier 14 at a constant temperature. The photoconductive drum 11 can contain an electrically heated heating element 30 as an additional heating device for heating up the transfer point 20.

When photoconductive drums 11 consisting of amorphous silicon are used, this drum heating can be omitted.

All the process means described above are arranged on chassis elements 31 by means of corresponding bearing or mounting means. These consist of aluminum die-cast parts which have fitting faces 32 on one side and fitting elements 33 on their other side. In order to mount the printing modules 10 in a housing 34 of the printer, support feet 35 are constructed at the lower edge of the chassis elements 31 with corresponding oblong holes to receive mounting elements 36 in the form of clamping screws.

The housing 34 has at the bottom a plurality of support rails 37. Support tables 38 are mounted on the support rails 37 by means of mounting elements 39. The support tables 38 which are constructed in the same way have oblong-like mounting openings on their surface for receiving the clamping screws 36, printing modules, elastic elements 40, for example made of rubber being arranged between the support feet 35 and the support tables 38 and ensuring a floating mounting of the printing module on the support tables 38.

A central supply unit for the printing modules 10 can be arranged under the support tables 37. This central supply unit which is not illustrated here can contain appropriate devices, which a produce partial vacuum, for the cleaning stations, toner reservoirs and disposal containers, magnetic storage means with floppy disk, etc. and a central control for the printer (controller).

Furthermore, the housing 34 serves to hold a paper guide channel 41 which is arranged above the printing modules and has paper rollers 42 as paper transport elements. Supply containers 43 for holding the individual sheets 15 are located at the beginning of the paper guide channel 41 and corresponding receiving containers 44 for the individual sheets 15 are provided at the output of the paper guide channel 41. Furthermore, a separating device 49, for example in the form of a paper cutting or tearing device, which can serve to pull off edge perforations of the recording carrier is also arranged there.

In order to permit both simplex and duplex printing a turning device 45 which can be constructed in accordance with PCT Published Application 89/08282 is located above the paper guide channel 41. It contains in the usual manner a return channel 46, turning channels 47 and paper rollers as paper transport elements. The entire turning device can also be arranged in a mirror-inverted fashion for reasons arising from the course of the paper.

The paper channel 41 is divided up, in accordance with the number of printing modules 10 arranged, into individual channels 41/1 and 41/2 which can be mounted separately from one another on the housing 34 by means of appropriate mounting elements in a longitudinally displaceable and detachable fashion. The transfer points 22 for the individual sheets of the printing modules 10 protrude into corresponding gaps between the individual channels 41/1 and 41/2.

As described at the beginning, the printing modules contain fitting faces 32 and fitting elements 33 for the sake of mutual allocation with an exact fit. The fitting face of the one printing module 10/2 is supported on the fitting elements 33 of the other printing module 10/1. This support is made possible by the floating mounting of the printing module of the printing modules 10 on the support tables 38 by means of the elastic elements 40, a positional prematching occurring by means of the clamping screws 36. The fitting faces permit exact association of the printing modules with one another irrespective of the number of printing modules used. As a result, an exactly defined distance between the transfer points 22 of the printing modules and thus a highly accurate paper guidance is obtained. The distance between the transfer points 22 can serve as a reference variable for the control of the individual sheets during transport through the paper guide channel 41.

If, as illustrated in FIG. 1, the printer is constructed as a two-color simplex/duplex printer, the printing modules 10/1 and 10/2 contain differently colored toner. The individual sheet removed from the receiving container 44 is initially printed on its underside with a first color by means of the printing module 10/1. The second printing module 10/2 superimposes a second differently colored print image on this print image. Afterwards, the individual sheet is fed back to the printing module 10/1 via the return channel 46, turned by means of a turning channel 47 and printed again in the described sequence on its other side by means of the printing modules 10/1 and 10/2 and deposited in the stacking container 44.

If the reverse side of the individual sheet is only to be printed in one color, it is already turned in the turning channel 47/2 associated with the printing module 10/2 and fed again to the printing module 10/2. Single-color or two-color simplex printing is also possible without using the turning device.

Figure 2:
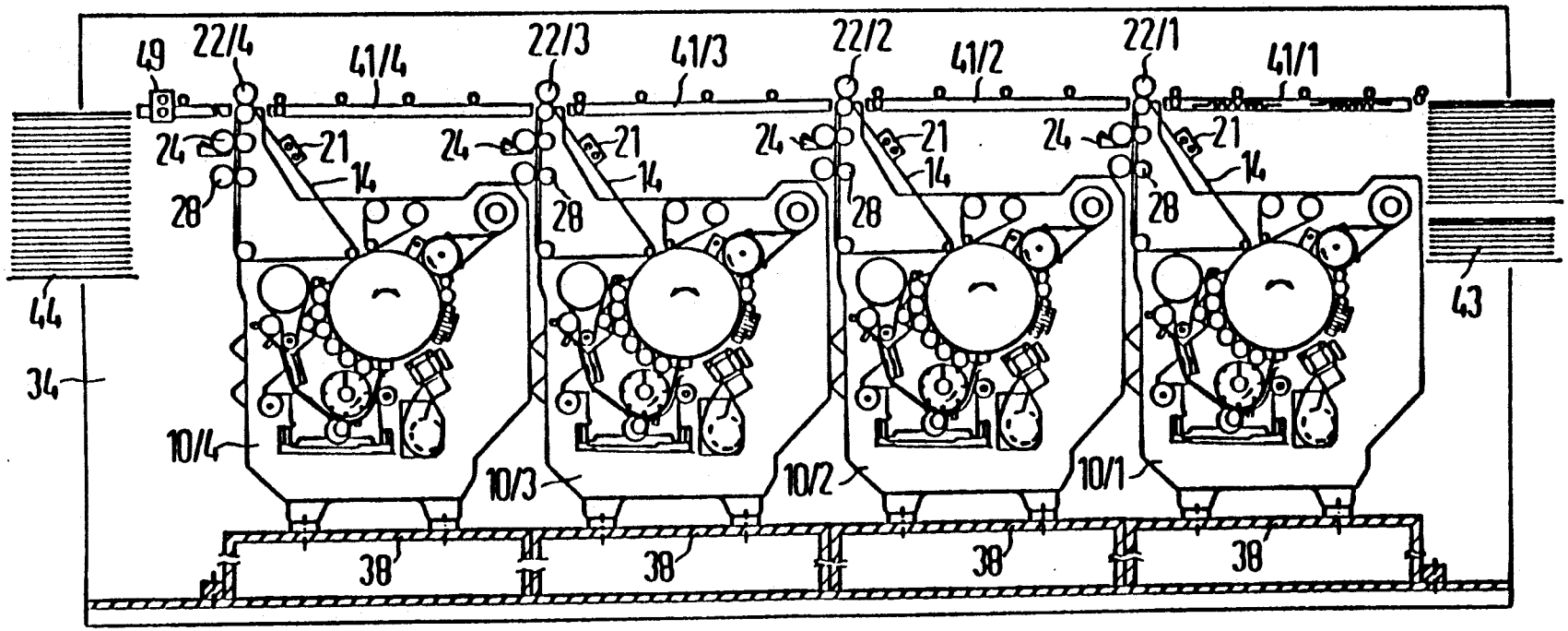
FIG. 2 shows a diagrammatic sectional view of an electrophotographic printer with intermediate carrier for four-color simplex printing.

The two-color simplex/duplex printer described with reference to FIG. 1 can be readily upgraded to form a four-color simplex printer in accordance with FIG. 2 by means of the multiple arrangement of the printing modules. All that is necessary for this is to mount additional support tables 38 on the correspondingly extended support rails 37 in order thus to widen the receiving surface for the printing modules. Additional printing modules 10/3 and 10/4 are then mounted on the additional support tables, specifically in such a way that the printing modules support one another by means of their fitting faces 32 and fitting elements 33. Additional individual paper guide channels 41/3 and 41/4 can then be arranged in the described manner between the transfer points 22 of the printing modules. By means of the exact positional association of the printing modules 10/1 to 10/4 with respect to one another and the thus defined distance between the transfer points 22 it is possible to adjust the position of the individual channels 41/1 to 41/4 in accordance with the respective printing modules 10/1 to 10/4. The housing 34 itself can be extended by inserting intermediate elements or by simply decoupling two housing parts. It is convenient here to divide up the housing elements in such a way that in each case fixed housing elements are associated with the stacking containers and the supply containers. In this way, the insertion of intermediate elements is made easier.

The invention has been described above with reference to printers which operate with individual sheets. However, it is also possible to use continuous paper, for example prefolded continuous paper, instead of individual sheets. Instead of the supply containers 43, a supply table would then be arranged to receive a supply stack and the stacking container would have to be replaced by a stacking table.

It is also possible to use a single printing module with a turning device, if, for example, the printer is to be designed as a single-color duplex printer.

Although other modifications and changes may be suggested by those skilled in the art, it is the intention of the inventor to embody within the patent warranted hereon all changes and modifications as reasonably and properly come within the scope of his contribution to the art.

I claim:

1. An electrophotographic printer with a housing and with a printing apparatus for printing recording carriers, the printing apparatus comprising:

a photoconductor with an associated exposure means for producing a charge image on the photoconductor, a developer means for inking the charge image with toner, a continuous, belt-shaped intermediate carrier means for transferring toner images which have been produced by inking the charge image onto the recording carrier, fixing means for fixing the toner image onto the recording carrier by pressure or heat and cleaning means for cleaning the intermediate carrier means and the photoconductor, said printing apparatus being constructionally combined to form a printing module which is designed as a separate constructional unit for mounting in the housing and means on the housing and on said printing apparatus for arranging next to one another a variably selectable number of further printing apparatus along a common transport channel for the recording carrier.

2. The electrophotographic printer as claimed in claim 1, wherein the printing apparatus include fitting means for arranging a plurality of the printing apparatus in rows in the housing in an exactly fitting manner.

3. The electrophotographic printer as claimed in claim 2, wherein said fitting means includes fitting faces arranged on chassis elements of the printing apparatus with associated fitting elements.

4. The electrophotographic printer as claimed in claim 3, wherein the printing apparatus further comprise: means for floatingly mounting said printing apparatus in the housing of the printer.

5. The electrophotographic printer as claimed in claim 1, further comprising, for printing sheet-shaped recording carriers on both sides, a transport channel for the recording carrier including a turning device for the recording carrier.

6. The electrophotographic printer as claimed in claim 1, wherein the printer is a multi-color printer comprising: a number of printing modules with colored toner corresponding to the number of elementary colors to be printed.

7. The electrophotographic printer as claimed in claim 1, further comprising: heating devices which set a temperature of the toner image in a contact area between said intermediate carrier and said photoconductor in such a way that the toner is in a pasty state and is transferred to the intermediate carrier by adhesive force.

8. The electrophotographic printer as claimed in claim 7, wherein the heating devices comprise heating elements for heating up the photoconductor.

9. The electrophotographic printer as claimed in claim 1, wherein said heating devices are first heating devices and further comprising: second heating devices which set the temperature of the toner image on the intermediate carrier in such a way that the toner, located in a contact area between said intermediate carrier and the recording carrier, is in a virtually liquid state of aggregation.

* * * * *